United States Patent [19]
Michalski

[11] 3,976,911
[45] Aug. 24, 1976

[54] ILLUMINATION SYSTEM AND METHOD AND MEANS FOR OPERATING IT

[75] Inventor: Maksymilian Michalski, Manhasset, N.Y.

[73] Assignee: Berkey Photo, Inc., Woodside, N.Y.

[22] Filed: Sept. 10, 1973

[21] Appl. No.: 396,107

[52] U.S. Cl. ..... 315/101; 315/118; 315/102; 315/105

[51] Int. Cl.[2] ..... H05B 39/00

[58] Field of Search ..... 315/112, 113, 117, 118, 315/D2, D5, 106, 101; 323/43.55

[56] References Cited

UNITED STATES PATENTS

| | | | |
|---|---|---|---|
| 1,530,123 | 10/1933 | Ernest et al. | 315/D5 |
| 2,359,021 | 9/1944 | Campbell et al. | 315/112 |
| 2,626,360 | 1/1953 | Wright | 315/106 |
| 3,246,201 | 4/1966 | Michalski | 315/D5 |

FOREIGN PATENTS OR APPLICATIONS

| | | | |
|---|---|---|---|
| 816,840 | 7/1969 | Canada | 323/43.55 |

*Primary Examiner*—Stanley D. Miller, Jr.
*Assistant Examiner*—B. P. Davis
*Attorney, Agent, or Firm*—Toren, McGeady and Stanger

[57] ABSTRACT

In the system disclosed, a transformer connected to an alternating power source establishes a continuous alternating output voltage which is connected directly across a gas discharge lamp to apply the voltage continuously across the lamp. The transformer output voltage is set within a range which includes a condition that causes the lamp to exhibit a positive impedance value when the lamp is discharging. The transformer and the source together exhibit an impedance substantially less than the impedance value of the discharging lamp.

22 Claims, 2 Drawing Figures

ILLUMINATION SYSTEM AND METHOD AND MEANS FOR OPERATING IT

BACKGROUND OF THE INVENTION

This invention relates to illuminating systems and particularly to graphic arts illuminating systems using gas discharge lamps and means and methods for energizing the lamps.

Such systems are used, for example, to illuminate color or black and white transparencies to be photographed by a camera, to illuminate originals to be copied by a camera, to illuminate transparencies in color enlargers, to expose plates or proofing or other photosensitive materials, and for other photographic graphic arts application.

Many of these systems utilize gas discharge lamps such as Xenon filled quartz lamps, as light sources because of their ability to emit large quantities of light in comparison with the amount of heat generated. However, a gas discharge lamp, when operated in a glow region, exhibits a negative resistance characteristic. A series impedance or ballast is used to prevent the lamp from drawing the vast quantities of energy which would ultimately destroy the lamp when it operates under these conditions. Such ballasts are costly and add substantial weight and bulk to the system.

Another method of preventing destruction of the lamp is to store energy during each cycle or half cycle of alternating voltage across a capacitor, and to apply the energy to the lamp in short high power pulses that drive the lamp into the arc discharge region. Effectively, this operates the lamp at instantaneous high powers but low average powers. This pulse mode of operation is frequently applied with Xenon filled quartz lamps. It produces high efficiency as measured in lumens per watt.

However, operating in the pulse mode requires expensive, bulky equipment, and requires operating at power factors less than unity.

An object of the invention is to overcome these disadvantages.

Another object of the invention is to lower the weight and bulk of such systems, and methods and means of driving the lamps in such systems.

SUMMARY OF THE INVENTION

According to a feature of the invention these objects are attained in whole or in part by applying sufficient alternating current power to operate the lamp in its arc discharge region so it exhibits an essentially positive resistance characteristic approaching the classical Ohms Law behavior where the current is proportional to the increase in the supply voltage. The power source and means which supply the power to the lamp exhibit an impedance substantially less than the positive impedance value of the discharge lamp when the lamp is discharging.

According to another feature of the invention, the lamp is cooled intensively by a blower directed at the lamp and the power supplied to the lamp is such that the heat dissipated by the lamp is the maximum at which the lamp is capable of operating continuously for the prevailing cooling of the lamp.

According to another feature of the invention, input means connectible to an alternating power source supply the power to transformer means which has an output for continuously establishing an alternating output voltage. Circuit means connect the alternating output of the transformer means directly across the lamp and continuously apply the voltage at the output transformer across the lamp. Control means in the transformer means set the voltage at the output of the transformer means within a range which causes the discharge lamp to exhibit a positive impedance value when the lamp is discharging. The input means and the transformer means as well as the circuit means together with the source exhibit an impedance substantially less than the positive impedance value of the discharge lamp when the lamp is discharging.

According to another feature of the invention, the power supplied to the lamp is such as to operate the lamp substantially continuously in the arc discharge region of the lamp.

According to another feature of the invention, the control means set the voltage of the output of the transformer means within a range which causes the discharge lamp to dissipate heat at the rate of 20 watts per square centimeter of the surface of the lamp.

According to another feature of the invention the lamp is composed of a quartz tube filled with Xenon.

According to another feature of the invention the lamp has an internal gas pressure of 40 millimeters.

According to another feature of the invention, starter means applies a trigger voltage which initiates the discharge of the lamp.

According to another feature of the invention, the transformer means is composed of an autotransformer, and the control means on the transformer includes a plurality of taps.

According to another feature of the invention the control means includes a set of switches which switch the connections of the taps to the autotransformer but which automatically disconnect heavy switch contacts applying the current to the transformer before disconnecting the taps, and which reconnect the contacts only after the taps have been changed.

According to another feature of the invention these contacts are relay actuated.

These and other features of the invention are pointed out in the claims. Other objects and advantages of the invention will become evident from the following detailed description when read in the light of the accompanying drawing.

DETAILED DESCRIPTION OF PREFERRED EMBODIMENTS

Figure 1:
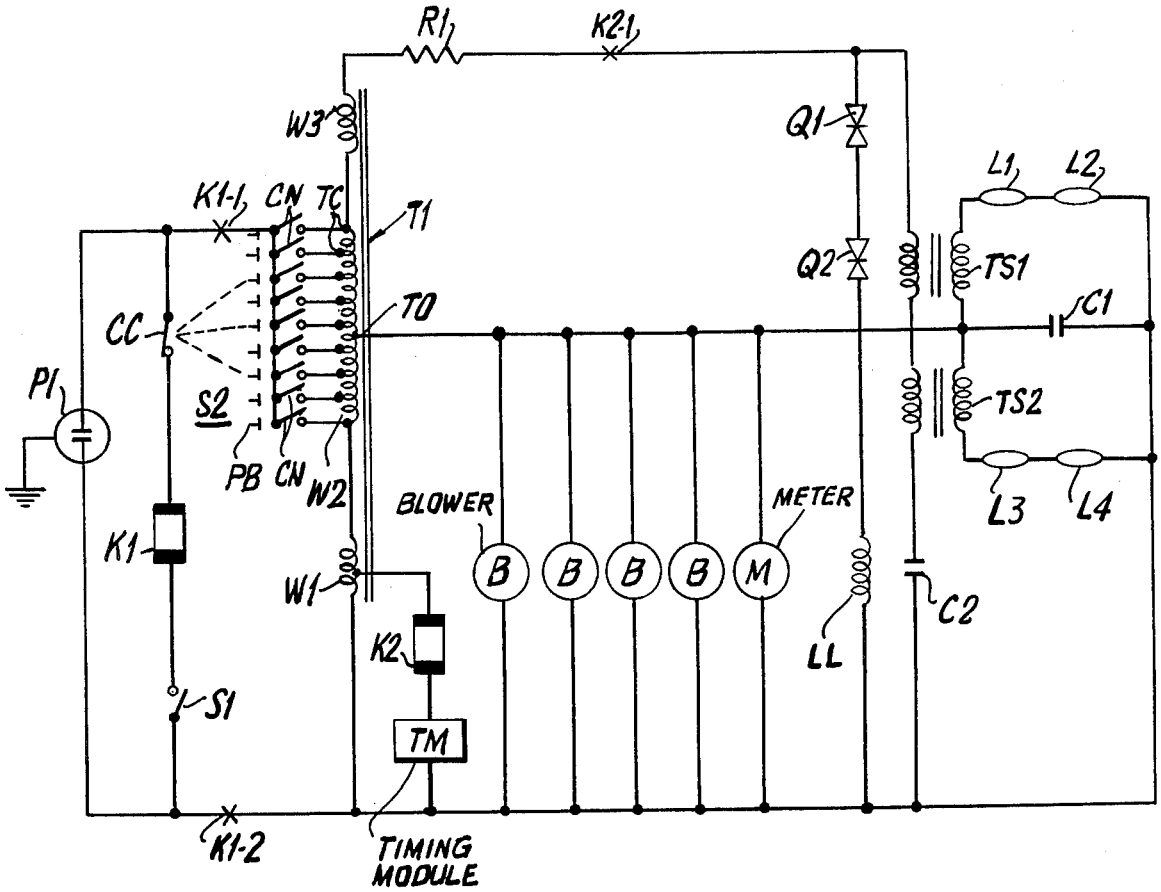
FIG. 1 is a schematic diagram illustrating a system embodying features of the invention.

In the drawing, a power cord P1 receives current from a power source such as a normal 200 to 250 volt industrial power source. When a starting switch S1 energizes a power relay K1 through a normally closed contact CC, two normally open heavy duty power relay contacts K1-1 and K1-2 close. These contacts pass the energy from the cord p1 to one of a number of taps TC on the central winding W2 of a transformer T1 whose three windings W1, W2 and W3 are connected in series to form an autotransformer. The winding W2 may be considered the secondary winding, the winding W1 may be considered the primary winding and the winding W3 a starter winding.

The particular tap TC which an operator connects to the power source P1 is the one which produces a voltage between 220 and 227 volts at an output tap TO. The latter supplies the output voltage to a first pair of lamps L1 and L2 connected in series with each other and a second pair of lamps L3 and L4 also connected in series with each other and connected in parallel to the first pair of lamps. Intervening between the tap TO and the lamps are the secondaries of two starter transformers TS1 and TS2 whose impedances are substantially negligible but which supply initial starting pulses to initiate the ionization originally necessary to produce the discharge in the lamps L1 to L4. The power supplied by the transformer T1 at the output voltage of 220 to 227 volts is sufficient to drive the lamps L1 to L4, (which may, for example, be 12 inch PXA 45 lamps available from the General Electric Company) after the lamps have been started, into an arc discharge that exhibits a positive impedance characteristic. The total impedance of the entire circuitry, including the source to which the cord P1 is connected, and including the transformers T1, TS1 and TS2, is negligible compared to the impedance of the discharging lamps L1 to L4.

In order to maintain the voltage at the tap TO at a suitable level for a wide range of input voltages at the cord P1, the switch S2 connects the starting contact CB1 to one of the taps TC by means of one of nine normally open contacts CN. The switch S2 also includes the normally closed contact CC. The latter supplies power to the relay K1 that closes the normally open heavy duty power relay contacts K1-1 and K1-2 in series with the lines coming from the cord P1. Each of the contacts CN is operated by a pushbutton PB. When any of the pushbuttons is depressed it reaches a first position in which it opens the contact CC and deenergizes the relay K1. This opens the contacts K1-1 and K1-2, thereby deenergizing the system. As the pushbutton for any of the contacts CN is further depressed, the switch S2 opens any previously closed contacts. Deenergization of the system through the contacts K1-1 and K1-2 prevents the contacts CN from arcing as they are opened. Further depression of the pushbutton ultimately closes the desired contact CN without the problem of sparking or arcing, and allows the contact CC to reclose. This energizes the relay K1 and closes the contacts K1-1 so as to reenergize the system.

Switches such as the switch S2 are known and available commercially from manufacturers such as the General Electric Company.

Each time the system is reenergized, a relay K2s receives excitation power from the winding W1 after a time period established by a timing module TM. The latter may be any type of timing device. When the relay K2 is energized, its relay contact K2-1 completes a circuit from the high voltage established by the winding W3, through a resistor R1, an inductor LL, and biswitches Q1 and Q2. The latter break down when the voltage reaches a predetermined potential during each half cycle of line voltage, this produces two or three pulses ringing at approximately 10KHz, which are applied through a capacitor C2 to the primary windings of the transformers TS1 and TS2. This starts discharge of the lamps L1 to L4. The discharge is of course maintained by the voltage appearing at the tap TO. A capacitor C1 completes a circuit for passing the pulses, applied by the secondaries of transformers TS1 and TS2 through the lamps L1 to L4, back to the transformer Secondaries.

Four blowers B, each mounted in the fixture of one lamp, are connected across the output of the transformer T1 at the tap TO.

External timing may be connected to the coil K1 for varying the timing operation of the system.

A meter M measures the voltage appearing at the tap TO. This affords an operator the opportunity to change the voltage applied across the lamps to a desired value.

In operation, an operator depresses the starter button S1 thereby energizing the relay K1 and closing the contacts k1-1 and K1-2. This provides power to the transformer T1 through a previously closed contact CN. The relay k2 is energized approximately 5 seconds later when the timing module TM permits the energization. As a result, contact K2-1 closes and completes the circuit through the biswitch Q1. The latter produces a trigger potential which is applied by the transformers TS1 and TS2 across the lamps L1 to L4. This trigger potential cooperates with the voltage appearing at the tap TO to break down the lamps L1 to L4. The voltage TO then drives the lamps into an arc discharge that exhibits a positive impedance. The operator then reads the voltage appearing at across the meter M. If the voltage lies within the desired range of 220 to 227 volts, the operator leaves the switch S2 in its position. However, if the voltage is outside this range the operator keeps depressing pushbuttons on the switch S2 until the appropriate voltage appears. During each change in operation of the contacts CN, the system is deenergized by de-excitation of the relay K1 and opening of the contacts K1-1 and K1-2. Upon re-excitation of the relay K1 and reenergization of the system, with each change of contact CN the starting circuit composed of the relay K2, biswitch Q1, timing model TM, resistor R1, and contact K2-1, as well as the transformers TS1 and TS2, restarts the lamps L1 to L4. The system is then used for exposure.

The voltage 220 to 227 volts is selected for the particular lamps being used in the system. Specifically, the voltage drives the lamps near a power range of 20 watts per square centimeter of lamp surface. The PXA lamps L1 to L4 each have a 12 inch arc length and a ⅜ inch diameter. This produces a total surface of 91.14 square centimeters. The continuous operating power is 1800 watts to produce 19.7 watts per square centimeter.

This power dissipation is the maximum power dissipation for the particular blower air cooling to which the lamps are subject. According to the invention the voltage at the tap TO, and hence the power applied to the lamps is increased even further when the lamps are subjected to other more effective types of cooling. It has been discovered that the luminous efficiency of the lamps increases with the power applied to the lamps. This increase in luminous efficiency reaches an optimum stage. However, it has been found that the ability of the lamp to dissipate the heat generated prevents operation near this optimum condition. In effect the operation of the lamps is heat limited. For this reason the lamps are operated at their highest feasible power within the heat limitations imposed by the cooling provided.

It should be noted that the optimum condition does not represent a condition where increased power application fails to produce greater luminous efficiencies. Rather it represents the knee of a curve at which the increases in luminous efficiency become smaller.

Figure 2:
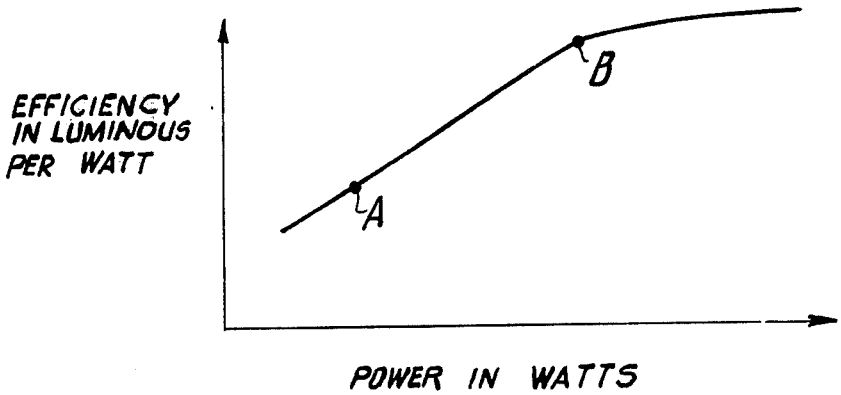
FIG. 2 is a graph illustrating the variation in efficiency of lamp operation with changing lamp input power.

FIG. 2 is a graph illustrating the increase in luminous efficiency of the system in FIG. 1. At 220–227 volts on tap TO, the operating point is at A and the optimum condition at B.

The invention furnishes a simple system for providing intensive light at high efficiency without the use of heavy, expensive, and bulky ballasts and without the need for triggering circuits that carry high trigger currents. The lamp life is maintained over a period of time corresponding to that of ballasted or pulsed systems.

By using an autotransformer, the system according to the invention obviates the need for extensive windings to carry the total currents passing to the lamps. Only those windings between the tap CN and the tap TO need carry this current.

The system is used for exposure in various photographic or graphic art applications by closing the control switch either manually or with a timer or integrator. The lamps are lit substantially continuously through each half cycle. This contrast with the pulsed mode in which the lamps are lit only briefly during each half cycle.

The system operates substantially at unity power factor. A sample power factor is 0.95.

Examples of the components of FIG. 1 are as follows:

| | | |
|---|---|---|
| L1 to L4 | General Electric PAX45 | Pulsed Xenon lamp 12" long at 44mm Hg. pressure at 1800 watts |
| Q1, Q2 | Hunt Electric Co. PDISO | |
| TM | Syracuse Electronics Co. SBS 7135 5 second delay module | |
| T1 | W1 = 324 turns 16 gage (AWG)<br>W2 = 81 turns of 10 gage (AWG) square<br>W3 = 756 turns 26 gage<br>Luminations 2¼ × 1¾ | |
| S2 | General Electric ASP9219-31 | |
| TS1, TS2 | Primary 3 turns 18 gage (AWG) secondary 90 turns 12 gage ferrile core 5 backpole No. 50303 | |
| B2 | Cooling Blowers 150 to 300 CFM | |

The invention makes it possible to utilize lower voltages to obtain the same lighting intensity than the voltages needed in the pulsed mode. This is so because the total energy needed each half cycle is spread over the duration of the half-cycle in the invention, rather than having that energy concentrated during the short pulses of the pulse mode.

While specific embodiments of the invention have been shown and described in detail to illustrate the application of the inventive principles, it will be understood that the invention may be embodied otherwise without departing from such principles.

What is claimed is:

1. A drive system for a gas discharge lamp, comprising input means connectible to an alternating power source, voltage varying means connected to said input means and having an output for continuously establishing an alternating voltage, circuit means connecting the alternating output of the voltage varying means directly across the lamp, control means in said voltage varying means for setting the alternating voltage at the output of said voltage varying means within a range which includes a condition that causes the discharge lamp to arc and exhibit a positive impedance value when the lamp is discharging, said input means and said voltage varying means as well as said circuit means together with the source means exhibiting an impedance less than the positive impedance value of the discharge lamp when the lamp is discharging.

2. An apparatus as in claim 1, wherein said voltage varying means includes a transformer.

3. An apparatus as in claim 2, wherein said transformer is connected as an autotransformer.

4. An apparatus as in claim 1, wherein said control means sets the voltage at the output of said voltage varying means within a range which includes a condition in which the heat dissipated by the discharge of the lamp is the maximum at which the lamp is capable of operating continuously for the prevailing cooling conditions.

5. An apparatus as in claim 4, wherein said voltage varying means includes a transformer.

6. An apparatus as in claim 5, wherein said transformer is connected as an autotransformer.

7. An apparatus as in claim 1, wherein said control means sets the voltage of the output within a range sufficient to cause said lamp to operate in the arc discharge region.

8. An apparatus as in claim 1, wherein said control means sets the voltage at the output at a condition in which the power at the lamp is approximately 20 watts per square centimeter of the external area of the lamp.

9. An apparatus as in claim 4, wherein said control means sets the voltage at the output at a condition in which the power at the lamp is approximately 20 watts per square centimeter of the external area of the lamp.

10. An apparatus as in claim 7 wherein said control means sets the voltage at the output at a condition in which the power at the lamp is approximately 20 watts per square centimeter of the external area of the lamp.

11. An apparatus as in claim 10, wherein said voltage varying means includes an autotransformer.

12. An apparatus as in claim 6, wherein said transformer includes a plurality of taps and said voltage varying means includes switch means for disabling said voltage varying means before changing the connection to a tap and for re-enabling the transformer means after connection to a tap.

13. An apparatus as in claim 7, wherein said voltage varying means includes an autotransformer having a plurality of taps and wherein said transformer includes a plurality of taps and said voltage varying means includes switch means for disabling said voltage varying means before changing the connection to a tap and for re-enabling the voltage varying means after connection to a tap.

14. An apparatus as in claim 8, wherein said voltage varying means includes an autotransformer having a plurality of taps and wherein said transformer includes a plurality of taps and said voltage varying means includes switch means for disabling said voltage varying means before changing the connection to a tap and for re-enabling the transformer means after connection to a tap.

15. An illuminating system, comprising a flash discharge lamp, cooling means for cooling the lamp, input means connectible to an alternating power source, voltage varying means connected to said input means and having an input for continuously establishing an alternating voltage at the output, circuit means connecting the alternating output directly across the lamp, control means in said voltage varying means for setting the alternating voltage of the output of said voltage varying means within a range which includes a condition that causes the lamp to arc and exhibit a positive impedance value when the lamp is discharging, said input means and said voltage varying means as well as said circuit means together with the source means exhibiting an impedance substantially less than the positive impedance value of said discharge lamp when the lamp is discharging.

16. A system as in claim 15, wherein said voltage varying means includes an autotransformer.

17. A system as in claim 15, where said control means sets the voltage at the output of said voltage varying means within a range which includes a conditon in which the heat dissipated by the discharge of the lamp is the maximum at which the lamp is capable of operating continuously for the cooling provided by said cooling means.

18. A system as in claim 15, wherein said control means sets the voltage at the output at a condition in which the power at the lamp is approximately 20 watts per square centimeter of the external area of the lamp.

19. A system as in claim 15, wherein said voltage varying means includes a transformer having a plurality of taps and wherein said transformer is connected as an autotransformer.

20. An apparatus as in claim 15, wherein said voltage varying means includes switch means for disabling said voltage varying means before changing the connection to a tap and for re-enabling the transformer means after connection to a tap.

21. An apparatus as in claim 18, wherein said voltage varying means includes switch means for disabling said voltage varying means before changing the connection to a tap and for re-enabling the voltage varying means after connection to a tap.

22. An apparatus as in claim 15, where said cooling means includes a blower.

* * * * *